United States Patent [19]

Lundberg

[11] Patent Number: 4,724,426

[45] Date of Patent: Feb. 9, 1988

[54] ANTI-THEFT ALARM SYSTEMS FOR STORES

[75] Inventor: Leif B. Lundberg, Motala, Sweden

[73] Assignee: Luxor AB, Sweden

[21] Appl. No.: 836,473

[22] Filed: Mar. 5, 1986

[30] Foreign Application Priority Data

Mar. 8, 1985 [SE] Sweden ..... 8501141

[51] Int. Cl.[4] ..... G08B 13/24

[52] U.S. Cl. ..... 340/551; 340/533; 340/572

[58] Field of Search ..... 340/551, 533, 524, 572, 340/552, 554

[56] References Cited

U.S. PATENT DOCUMENTS

| | | | |
|---|---|---|---|
| 3,680,074 | 7/1972 | Lieser | 340/554 |
| 3,691,558 | 9/1972 | Hoard et al. | 340/554 |
| 4,249,167 | 2/1981 | Purinton | 340/572 |
| 4,308,530 | 12/1981 | Kip et al. | 340/572 |

FOREIGN PATENT DOCUMENTS 2819952 6/1978 Fed. Rep. of Germany .

*Primary Examiner*—Glen R. Swann III

*Attorney, Agent, or Firm*—Burns, Doane, Swecker & Mathis

[57] ABSTRACT

In self-service stores, pay desks are usually arranged in a row side by side. Anti-theft detectors are often arranged in conjuction with the pay desks, and comprise coil loops generating magnetic fields. The coils are usually fed with a common alternating current. The result of this is that an alarm-generating object at one pay desk can give an alarm at the detectors of an adjacent pay desk. The invention is based on feeding the coil loops in alternate systems with one alternating frequency and the ones in between with a deviating frequency, whereby detection isolation between the systems with the same frequency is achieved.

4 Claims, 1 Drawing Figure

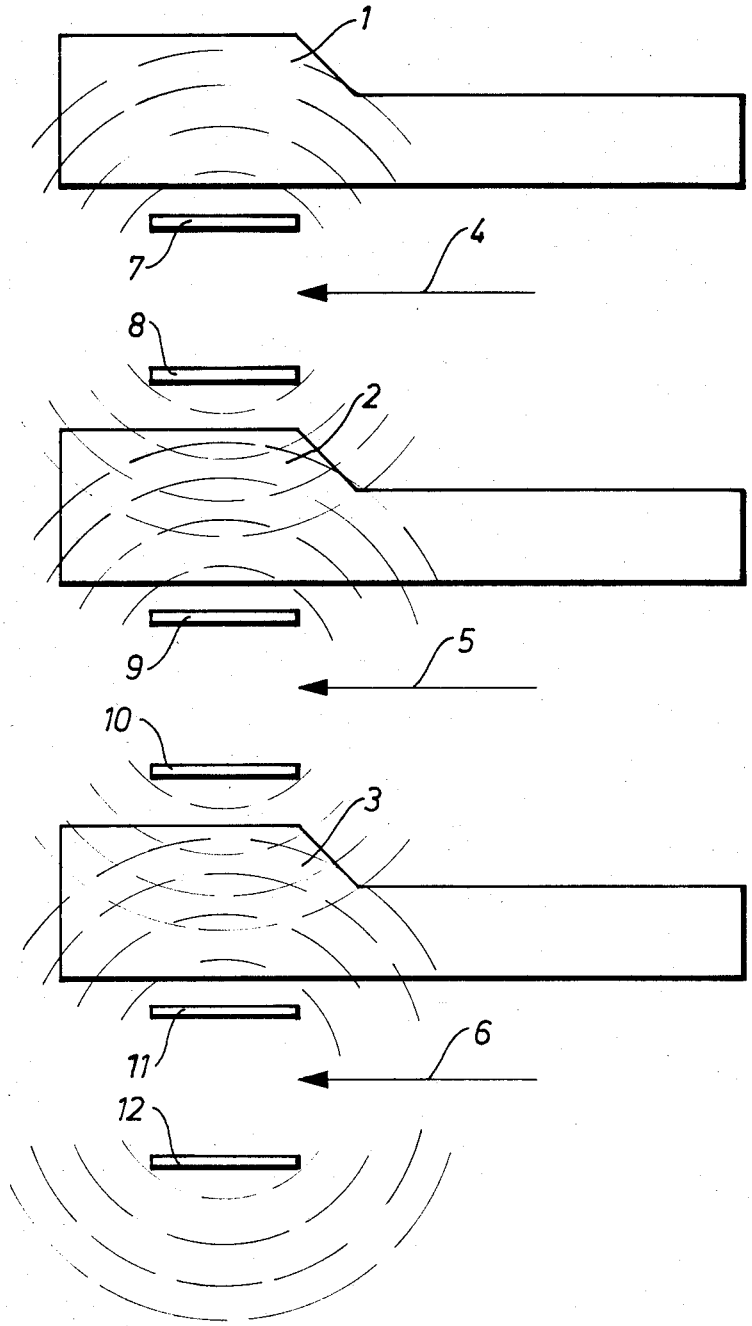
1
7
4
8
2
9
5
10
3
11
6
12

ANTI-THEFT ALARM SYSTEMS FOR STORES

BACKGROUND OF THE INVENTION

Modern self-service stores are often equipped with a number of pay desks arranged in rows adjacent the exit from the store. To prevent the unauthorized removal of goods from the stores via the pay desk passages, these are at present usually provided with anti-theft detectors, which are disposed for co-action with anti-theft tags attached to the respective goods, e.g. in the form of a section of magnetic tape. Such installations usually operate according to the magnetic field principle, i.e. a magnetic alternating field is directed across the passage along which the customer is to pass. The alternating field is achieved by coil loops on either side, forming a portal in the passage. The coil loops are fed with an alternating current of given frequency, receiver coil loops being arranged in the respective portals and connected to detectors which react from the overtone oscillations generated by the applied alternating field when an anti-theft tag comes into the field.

With the aid of a conveyor belt outside the magnetic field, the goods are moved past the pay desk, where the tag is put into an inactive state in conjunction with reading the price code. On the other hand, the customer passes through the magnetic field, and possibly hidden goods provided with anti-theft tags are then detected such as to trigger an alarm.

In general, a plurality of coil systems are coupled together in the portals and are driven from a common alternating current source, all portal passages then having the same frequency in their alternating fields. This is a very economical and rational solution, but in practice certain disadvantages have been found to occur when the detector sensitivity must be taken to a very high level, e.g. for being able to detect active anti-theft tags in a shopping cart (which generally serves as a magnetically screening cage). It has thus been found that, due to random field effects, the degree of detection at a pay desk has been deteriorated by shopping carts, baby carriages etc. passing by an adjacent pay desk. Furthermore, this effect also causes false alarms in adjoining systems. This is of course quite unsatisfactory, and can create irritation, apart from there being difficulty in locating the origin of alarm.

In order to solve the problems mentioned, attempts have been made to arrange assorted plates and turbulent current-catching screens between the pay desks. However, it has been found that such arrangements, no matter how well they may be balanced and matched, have a deleterious effect on the sensitivity of the detectors.

SUMMARY OF THE INVENTION

The present invention relates to a simple and well-adapted solution to the problems in question. The invention is essentially based on genertaing two mutually deviating alternating current frequencies, each of which is arranged to be applied to the portals in alternate detection passages, or in practice, alternate pay desk passages. This means that between two coil loop portals with the same alternating field frequency there is a portal with a differing frequency.

BRIEF DESCRIPTION OF THE DRAWING

The drawing FIGURE is a schematic view illustrating an embodiment of the present invention.

DETAILED DESCRIPTION

The invention will be now be described in detail with reference to an embodiment, which is schematically illustrated on the accompanying drawing. The illustrated installation comprises a section of a row of self-service store pay desks in a practical case, three desks denoted 1,2, and 3 being shown here. Customer passages past the respective pay desk are denoted by the arrows 4,5 and 6. So-called alarm portals comprising coil loop configurations are built up around each passage. For the passage 4 there are coil loop configurations 7,8, for the passage 5 configurations 9 and 10 and for the passage 6 configurations 11 and 12. In a manner not more closely illustrated, the configurations 7,8 (pay desk 1) and 11,12 (pay desk 3) are fed with an alternating current of a particular frequency. On the other hand, the configurations 9,10 (pay desk 2) are fed with an alternating current having a frequency deviating from that of the one just mentioned, this deviating alternating current also being applied to an unillustrated alarm portal for a pay desk in the row after the pay desk 3.

By the illustrated distribution of alternating currents with different frequencies the pay desk 2 will have its alarm portal 9,10 operating at a frequency deviating from that of the pay desks 1 and 3 on either side of it. This means that the overtone oscillation which could be detected for pay desk 2 will be completely different from possibly generated overtone oscillations associated with the pay desks 1 and 3 and caused by any active alarm tags in shopping carts or baby carriages. By this arrangement the physical distance between two pay desks with the same portal frequency will be greater than if there was one and the same frequency in all portals. A further essential advantage is achieved with this principle, namely that the signal-noise ratio is improved, since when all portals operate at the same frequency the noise level for a given system is the sum of the noises generated by the system itself and those generated in the nearest situated system. In this way there is achieved security against incorrect alarm conditions while at the same time all forms of screening plates and the like between the pay desks will be superfluous. Arranging a special alternating current frequency for each pay desk is not suitable in practice, although it is capable of execution, since an oscillator with an output amplifier must then be arranged for each portal. Furthermore, there may easily occur interference and phase problems in such a system, and these can be difficult to overcome.

For carrying out the invention, coil system configurations known per se may of course be used to form the alarm portals, but in applicable cases the configurations may naturally be adjusted to the frequency conditions in question to achieve the best detection result. An arrangement in accordance with the invention can naturally be used in other connections, than what has been shown by way of example in connection with the control of objects or persons who are to pass through certain passages. What is important in practice is that the frequencies shall have a relationship to each other such that overtones of lower or higher order from the two basic frequencies do not interfere in the passband of the respective signal receiver.

The distinguishing features of the invention are disclosed in the following claims.

What is claimed is:

1. Arrangement for reducing interference noise between adjacent magnetic field generating detection systems, particularly in conjunction with store anti-theft installations, comprising:

a first set of opposed coil loops for detecting anti-theft tags, said coil loops generating the magnetic field in one system and being of a first frequency; and a second set of opposed coil loops for detecting anti-theft tags, said second set of coil loops generating the magnetic field in another system adjacent a first side of the one system at a second frequency, different from said first frequency.

2. The arrangement as claimed in claim 1 comprising:

a third set of coil loops for detecting anti-theft tags, generating a magnetic field in a third system adjacent a second side of the one system, opposite the first side, at said second frequency.

3. An anti-theft alarm system for stores comprising:

a plurality of side-by-side passage gates, each passage gate including a pay desk and a means for detecting anti-theft tags and avoiding false detection, including a respective pair of opposed coil loops having an alternating current, one of said passage gates operating said coil loops at a first frequency, and another passage gate on a first side of said one passage gate operating said coil loops at a second frequency, different from said first frequency.

4. The alarm system of claim 3, further including:

a further passage gate on a second side of said one passage gate, opposite said first side, operating said coil loops at said second frequency.

* * * * *